United States Patent [19]

Lapini et al.

[11] Patent Number: 4,972,670

[45] Date of Patent: Nov. 27, 1990

[54] PROCESS FOR THE AUTOMATIC PRODUCTION OF ORNAMENTAL LINK CHAINS

[75] Inventors: Corrado Lapini, Civitella Val di Chiana; Franco Esposito, San Giuliano, both of Italy

[73] Assignee: C.M.S. S.P.A. Costruzione Macchine Speciali, Arezzo, Italy

[21] Appl. No.: 397,682

[22] Filed: Aug. 23, 1989

Related U.S. Application Data

[63] Continuation-in-part of Ser. No. 244,629, Sep. 12, 1989, Pat. No. 4,872,305, which is a continuation of Ser. No. 16,357, Feb. 19, 1987, abandoned.

[30] Foreign Application Priority Data

Feb. 28, 1986 [IT] Italy ..... 9343 A/86

[51] Int. Cl.[5] ..... B21L 7/00

[52] U.S. Cl. ..... 59/20; 59/18; 59/35.1; 59/80

[58] Field of Search ..... 59/1, 16, 18, 20, 22, 59/80, 78, 35.1, 28, 17

[56] References Cited

U.S. PATENT DOCUMENTS

| | | | |
|---|---|---|---|
| 2,617,250 | 11/1952 | Kunzmann et al. | 59/17 |
| 2,893,201 | 7/1959 | Jaeger | 59/80 |
| 3,342,024 | 9/1967 | Campbell, Jr. et al. | 59/28 |
| 4,175,379 | 11/1979 | Tega | 59/16 |
| 4,275,555 | 6/1981 | Bichi | 59/18 |
| 4,503,664 | 3/1985 | Allazzetta et al. | 59/16 |
| 4,548,031 | 10/1985 | Massimo et al. | 59/18 |

FOREIGN PATENT DOCUMENTS

| | | | |
|---|---|---|---|
| 615396 | 6/1932 | Fed. Rep. of Germany | 59/17 |
| 359689 | 10/1931 | United Kingdom | 59/17 |

*Primary Examiner*—David Jones
*Attorney, Agent, or Firm*—Browdy and Neimark

[57] ABSTRACT

A method for rendering automatic the production of ornamental chains of the kind known as "partridge's eye" and the like, wherein two link elements shaped as a turn are linked to form a link of the chain so that the free ends of one are roughly at the center of the other. Then the link is compressed transversally and axially to cross said end portions of the two link elements, so that the free ends of one element come into contact with the internal contour of the other. The link formed in this way is twisted, at its ends, welded in correspondence with the overlap points of the two link elements, and then linked to a link element suitable to form the subsequent links.

7 Claims, 9 Drawing Sheets

PROCESS FOR THE AUTOMATIC PRODUCTION OF ORNAMENTAL LINK CHAINS

RELATED APPLICATIONS

The present application is a continuation-in-part of U.S. patent application Ser. No. 07/244,629, filed Sept. 12, 1989, now U.S. Pat. No. 4,872,305, which is a continuation of Ser. No. 07/016,357, filed Feb. 19, 1987, now abandoned.

BACKGROUND OF THE INVENTION

1. Field of the Invention

The present invention relates to a process for the automatic production of ornamental link chains.

More precisely, the invention relates to a process for the automatic production of a kind of chain known in the field of precious and non-precious jewelry by the term "partridge's eye". Such chains, as it is known, are composed of a series of links, flattened and twisted with respect to a common lying plane, each link being formed by two link members having the shape of one turn of a spiral, with the respective end portions crossed and engaged with each other so that the ends of the terminal parts of one contact the internal profile of the other. In the attached FIG. 1, the kind of chain above identified is shown at the end of its production cycle and before the surface finishing operations. In FIG. 2 the same kind of chain is shown as it appears after one of the possible surface finishing treatments.

The present invention relates moreover to an apparatus for the automatic production of the above described type of chain and operating according to the process subject of the invention.

2. The Prior Art

The ornamental link chains of the kind "partridge's eye" have been produced up to now exclusively by manual techniques. According to these techniques slightly open spires are first prepared from wire-like material obtained in various ways, and these are attached, in sequence, to each other, thus obtaining a rough specimen of a continuous chain having a limited length. The single turns, or link elements, linked to each other, are then deformed by exertion of pressure, using a suitable tool, on the "belly" of each one, i.e., in a direction at right angles to the axis of the chain, so that the two terminal ends of each turn cross each other beyond the halfway point of the turn itself. The shaping of the link is then carried out by placing the turns opposite each other two-by-two, and precisely by rotating alternating turns through 180° over the average plane of the chain, so that after said rotation in each link, the ends of the crossed portions of one is in contact with the internal profile of the other. Then the hand-performed welding of the overlapping points of the link elements in each link is carried out. The chain thus obtained has a very irregular contour, because it is prepared with links of the flat kind, and consequently it tends to rotate around its own axis, whereas in order to obtain a uniform product it is necessary that the links be of the twisted type. Said twisting of the ends of the links is performed by blocking one end of the chain on a chuck and the other with a fixed vice. The rotation of the chuck causes the twisting of the ends of the links which is necessary in order to obtain a uniform product.

From the above it results clearly that the manual production process for this kind of chain is extremely fatiguing and/or stressful for the operator and requires appreciable precision and skill. Moreover, due to the extreme weakness of the coupling of the chain before the welding thereof, the risk of the chain coming apart is very high, even if it is produced in limited lengths. This constitutes a further inconvenience from the production point of view.

The danger of the chain coming apart during handling is particularly acute when a continuous link-by-link welding operation is not feasible, that is, when a conventional welding over the entire chain is preferred. In this case, the chain may separate during subsequent handling before the welding operation is performed.

SUMMARY OF THE INVENTION

A process has now been set up, and constitutes the object of the present invention, which allows the automatic production of chains of the above mentioned kind, overcoming the inconveniences and disadvantages encountered up to now with the manual production techniques, assuring moreover higher production rates with respect to those obtained with the above-mentioned techniques.

The main feature of the process according to the present invention consists in the fact that the formation of the chain proceeds through the shaping of subsequent links, constituted as above-mentioned of turn-shaped link portions, which are closed by welding at the moment of shaping. The link which is being shaped each time has a link member engaged with the last link in the chain already formed. In this way the formation of the chain is performed in a continuous way, without limitations with respect to the length which may be produced and without the risk of an accidental breakage.

Another important feature of the process according to the present invention is the fact that each link is formed starting from two turns obtained from two open spirals of wire-like material which develop in the same direction side-by-side to each other. The single turns, consequently, once separated from the spiral, are already placed in the coupling position, coupling of which is obtained by bringing them towards each other until they intersect, by compressing and by axially twisting them until the deformation described above is obtained. In such a way the formation of the chain is particularly straightforward.

An object of the present invention is therefore a process for the automatic formation of ornamental link chains, in particular of the kind known in the field of precious and non-precious jewelry as "partridge's eye". The process is characterised in that two link elements each shaped as one turn of a spiral, one of which is engaged with the last link of the chain already formed, are engaged with each other until the free ends of one are substantially at the center of the other. The link that results from the combination of said elements then being compressed along two directions at right angles to each other, respectively along the same plane as and at right angles to the average lying plane of the links, in order to deform the two link elements so that the terminal ends of each of them are crossed until their ends are brought into contact with the internal contour of the other. Then the link coupled in this way is axially twisted, the welding is performed at the contact points of the intersecting edges of the two link members, and then the free link member of the link so formed is engaged with a subsequent link member to repeat the cycle.

Preferably the link members are obtained two-by-two from two spirals of wire-like material produced side-by-side, with parallel axes and developed in the same rotational direction, so that these turns are already correctly positioned for their mutual coupling, after they have been severed.

A second embodiment of the method according to the present invention has as its object to reduce the possibility of a chain coming apart when conventional welding over the entire chain is involved. This embodiment is also useful when the chain is formed by very small links or the diameter of the wire is very small. According to this embodiment, when forming each link from the two relevant link elements, the connection between the elements must be as close as possible. The link compression occurs in two successive steps. In the first step, the free ends of one link member approach, but do not come into complete alignment with the internal profile of the other link member. While the link members are still firmly blocked between the clamps, the vices are first rotated in opposite direction through an angle greater than 45°, whereby the link members are twisted in opposite directions, and second, the direction of rotation of each vice is inverted and a new rotation of an angle equal to an angle exceeding 45° is performed. At the same time, the second compression step is performed by means of which the free ends of one link member is brought into alignment with the internal profile of the other link member.

According to the invention, an apparatus for the production of the above-described kind of chain is also provided, characterised in that it comprises:

two pairs of pliers suitable for grasping two link elements shaped as a turn, one of which link elements is engaged with the last link of the chain already formed, having a translational motion along their axial direction, to engage said link members one to another until the free ends of one is brought approximately to the center of the other, having a simultaneous angular motion around their axes to place the two link members on two planes offset from each other by an angle not greater than 90° before the engagement thereof, and having an opposed angular motion to place the two link members thus assembled side-by-side;

shaping means for the link suitable to be positioned around the link constituted by the coupling of said link members, and to perform a compression both in a transversal and in an orthogonal direction with respect to the plane of the link, in order to produce the sliding of the terminal ends of each link member over one another, crossing them until the respective terminal ends of one are against the internal contour of the other, each of said pliers being provided with a further rotational motion for twisting each link member in an opposite direction to the other, while the link is blocked by said shaping means;

welding means suitable for bonding the two link members thus coupled in correspondence with their overlap points;

means for rendering said link members available in pairs, and for performing the linking of one of them to the last-formed link.

In particular, for the production of said link members, a unit for the generation of two open spirals of wire-like material is provided, along with knife means for cutting the two turns constituting the link elements to be coupled each time. Moreover, preferably, the two pairs of pliers operate in two separate working positions, shifting alternately from one to the other, in the first working position the pliers providing for the collection of the two link members, as well as for the engagement of the last link with a subsequent turn, after the coupling, shaping and welding of the link which is performed in the second working position.

BRIEF DESCRIPTION OF THE DRAWINGS

Further features and advantages of the process and apparatus according to the present invention will appear more clearly from the following disclosure of a practical embodiment, referred to as a non-limiting example, with reference to the attached drawings, wherein.

DESCRIPTION OF A PREFERRED EMBODIMENT

Figure 1:
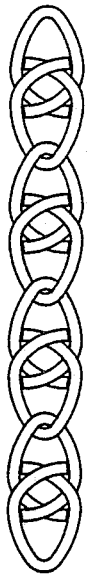
FIG. 1 shows a portion of a chain of the "partridge's eye" kind at the end of the production cycle of the same and before the finishing treatments.
Figure 2:
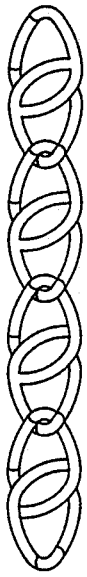
FIG. 2 shows the same chain after the finishing treatment.
Figure 3:
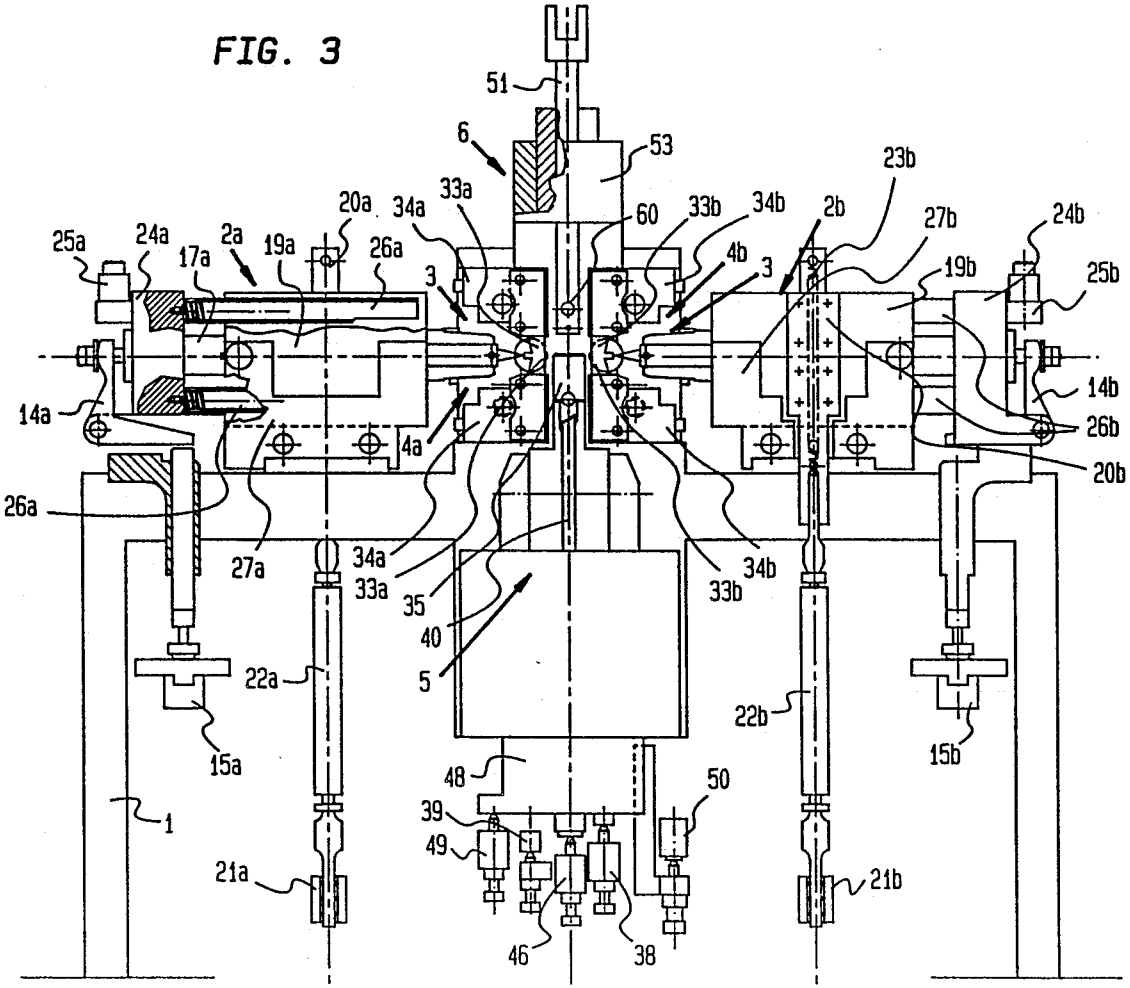
FIG. 3 shown a front view, with sectioned parts, of the apparatus according to the present invention.

With reference to FIG. 3, the apparatus according to the present invention comprises a metal supporting frame generally shown as 1, carrying two opposed vice groups 2*a* and 2*b*, a unit 3 for the production of spirals made of wire-like material, precious or not, arranged centrally between the two vice groups 2*a* and 2*b*, two groups of knives 4*a* and 4*b* in front of unit 3 and the two vice groups 2*a* and 2*b*, a group 5 for the shaping of the link arranged between the two vice groups 2*a* and 2*b* and then a welding group 6 above the group 5 for the shaping of the link.

Figure 4:
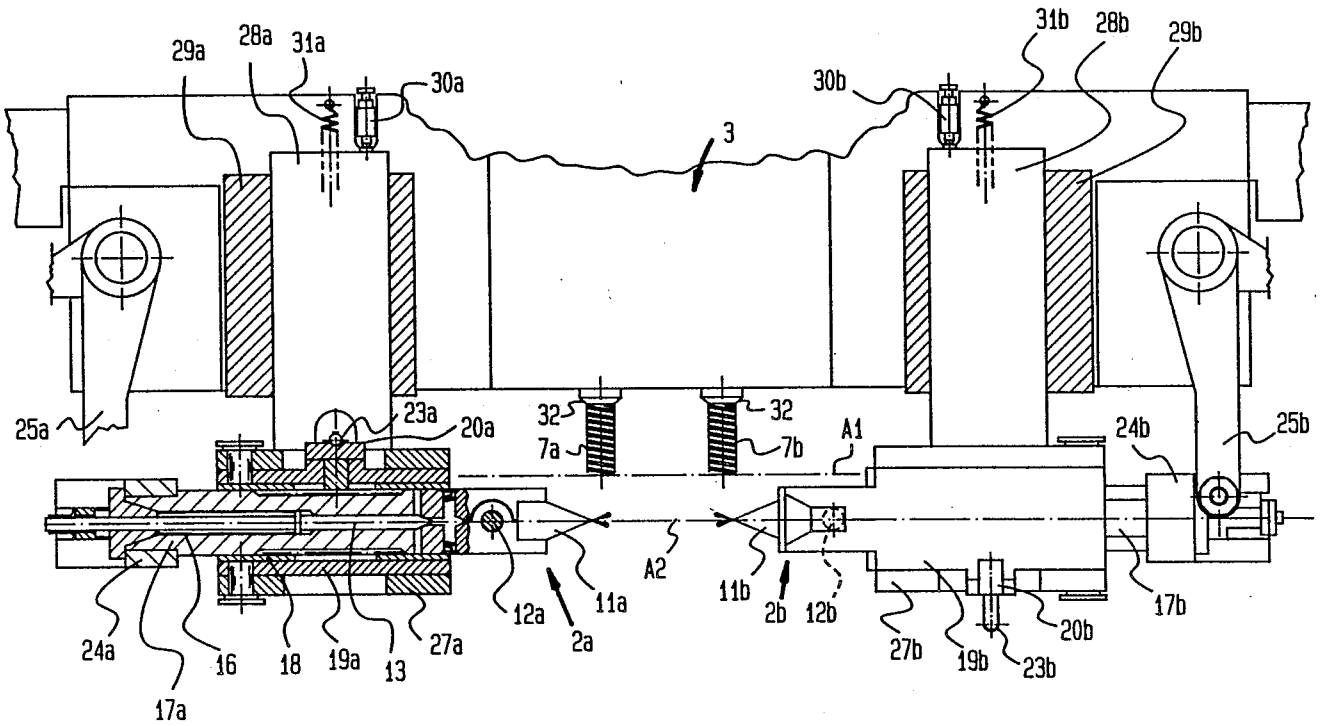
FIG. 4 is a top plan view with sectioned parts and parts omitted for the sake of simplicity, of the apparatus of FIG. 3.
Figure 5B:
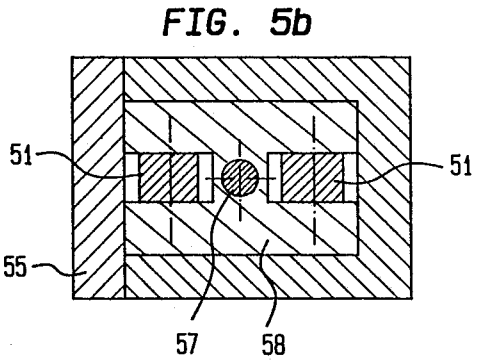
FIG. 5*a* and 5*b* show an enlarged sectional view of the upper right part of the apparatus and a sectional view A—A, respectively.
Figure 5A:
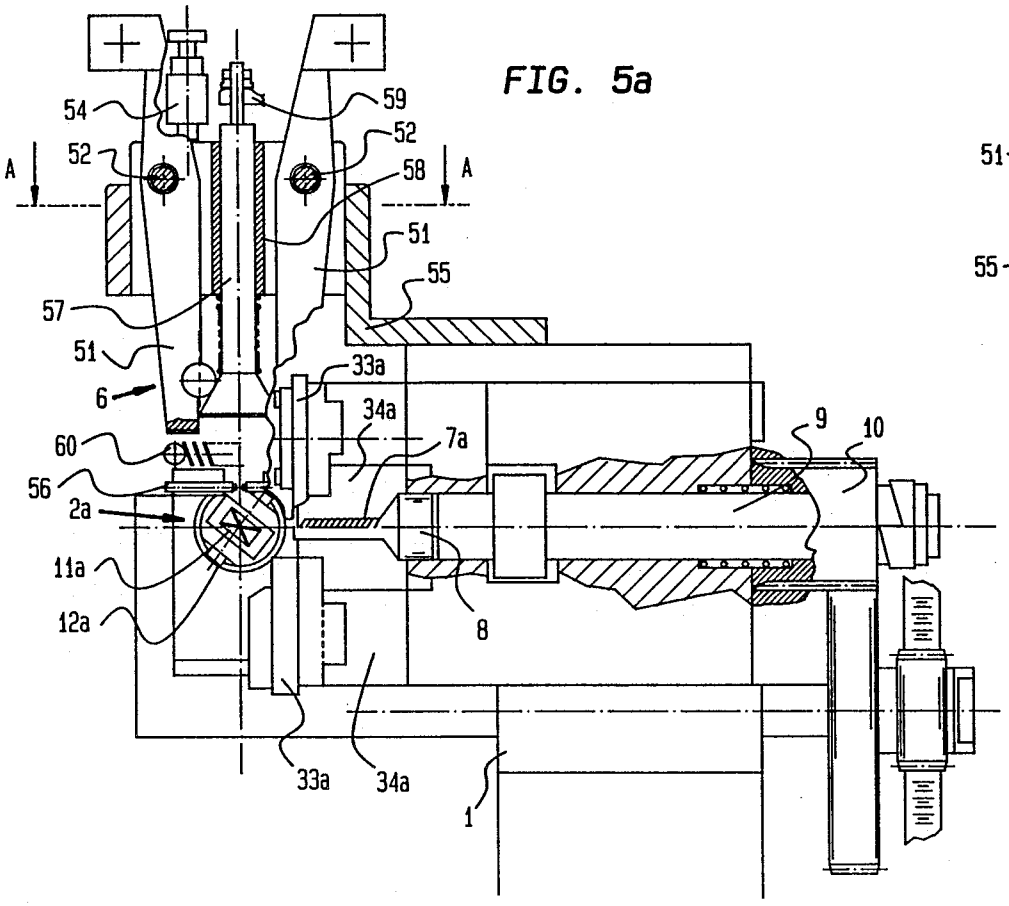
Figure 6B:
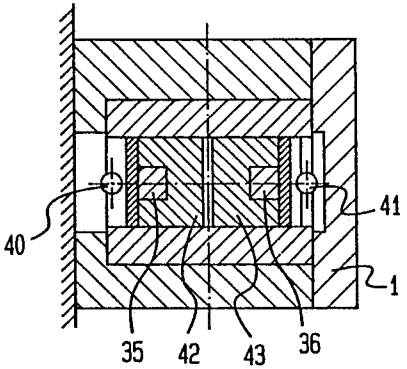
FIG. 6*a* and 6*b* show an enlarged sectional view of the lower right part of the apparatus and a sectional view B—B, respectively.
Figure 6A:
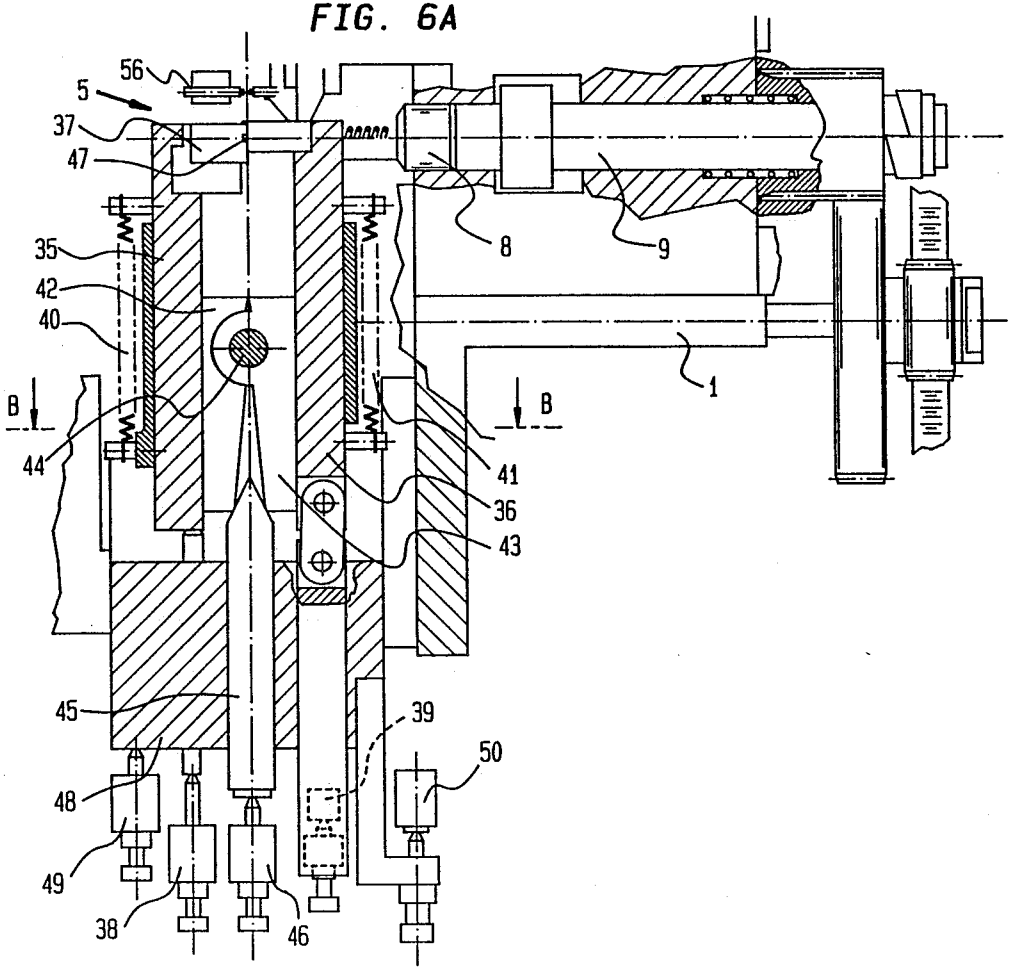

As shown in FIGS. 4, 5*a* and 6*a*, the spiral forming unit 3, fastened to the frame 1 and of a conventional kind, produces through respective outlet conduits 32 two spirals of wire-like material 7*a* and 7*b*, which are parallel and placed side-by-side. The forming of the two spirals in the unit 3 is effected in a known way by means of a pin having an intermittent unidirectional rotational motion which provides for the advancement of the wire and for its twisting by forcing it within a substantially helicoidal slot machined on the internal surface of a guideway 8. The pin (not shown) is connected to a shaft 9 rotated by a pinion 10 connected, in a known way, through transmission members, to the motor shaft (not shown) of the apparatus.

The two vice groups 2*a* and 2*b* each comprises a vice 11*a* (11*b*), the two arms of which are hinged on to the pin 12*a* (12*b*) and are made to open and close by means of a wedge 13 sliding within a tubular seat 17*a* (17*b*) activated in its turn by two levers 14*a*, 15*a* (14*b*, 15*b*) operating against the return spring 16. The tubular seat 17*a* (17*b*) is, in its turn, rotatably arranged on bus hinges 18 within a sleeve 19*a* (19*b*) laterally provided with an opening within which a vertical rack 20*a* (20*b*) is arranged, which engages itself with a toothed intermediate portion of the tubular seat 17*a* (17*b*), impressing on said tubular seat, and consequently on the vice 11*a* (11*b*) to which it is connected, a reciprocating rotary motion. The motion of the rack is obtained by means of a lever 21*a* (21*b*), the relative tie rod 22*a* (22*b*) and return spring 23*a* (23*b*). The two vices 11*a* and 11*b*, arranged opposite to each other, may also slide along their axial directions to approach each other or to move away from each other. To this end the tubular guideway 17*a* (17*b*) is connected to the bracket 24*a* (24*b*) on which rests the end of the lever 25*a* (25*b*) operating against the return springs 26*a* (26*b*) fastened on the sleeve 19*a* (19*b*). The sleeve 19*a* (19*b*) is then carried by a support 27*a* (27*b*) connected to a slide 28*a* (28*b*) slidable on guideways 29*a* (29*b*) fastened to the structure through a lever 30*a* (30*b*) operating against a return spring 31*a* (31*b*). In this way the two vice groups 2*a* and 2*b* may shift horizontally and parallel to themselves in a direction normal to their axes to place the respective vices 11*a* and 11*b* in two different working positions shown in A1 and A2, respectively (FIG. 4).

Figure 7:
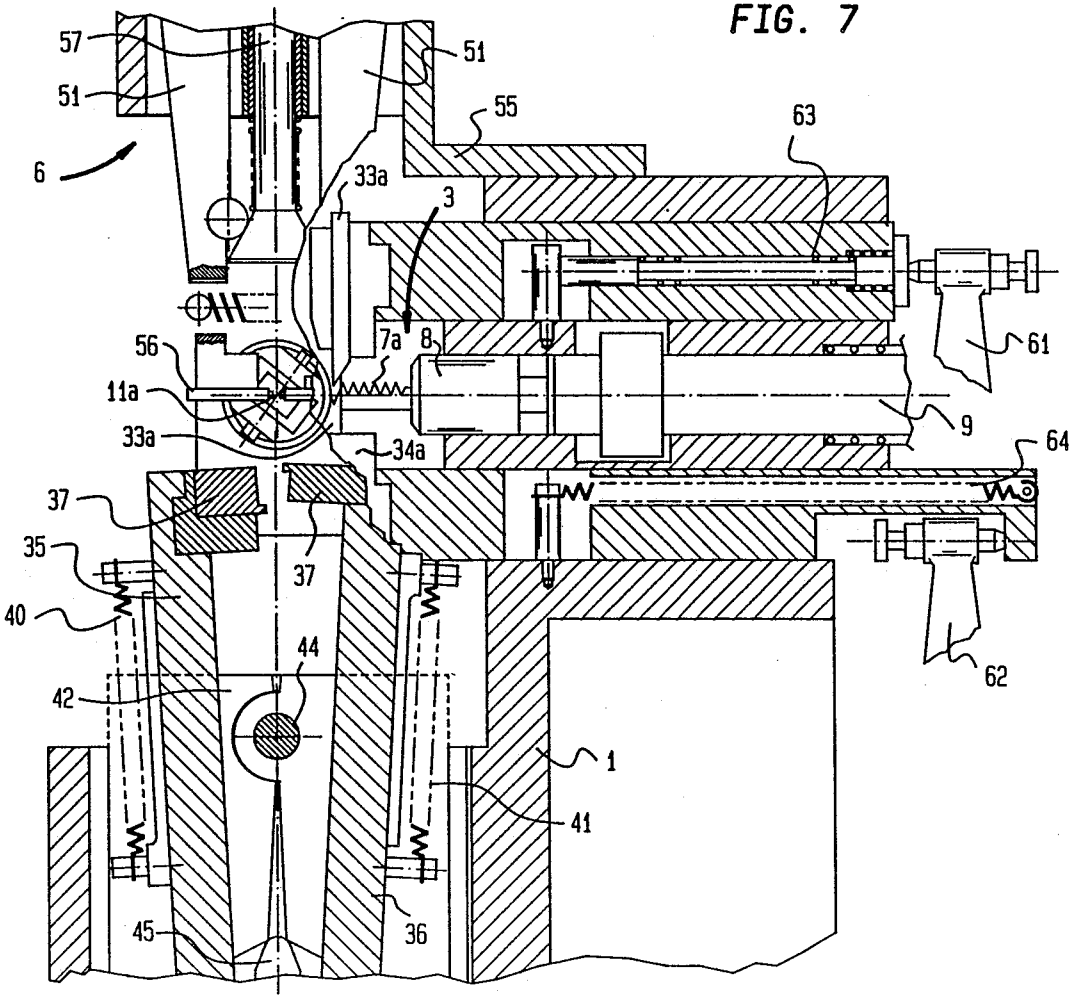
FIG. 7 shows, in a lateral view similar to that of FIGS. 5*a* to 6*b*, the position of various members of the apparatus according to the invention at the moment of welding.

The two groups of knives 4*a* and 4*b*, shown in particular in FIGS. 3, 5*a* and 7, each comprise a pair of cooperating blades 33*a* and 33*b*, respectively, vertically aligned in front of each of the two spirals 7*a* and 7*b*. The two pairs of blades 33*a* and 33*b* are fastened to two pairs of slides 34*a* and 34*b*, respectively, slidable in a horizontal direction parallel to the axis of the spiral, under the action of two levers 61 and 62 operating against the return springs 63 and 64 (FIG. 7).

The link forming group, generally indicated with the reference number 5 and illustrated in detail in FIGS. 3, 6*a* and 7, comprises two parallel slides 35 and 36, carrying on their upper ends a pair of clamps 37. The two slides 35 and 36 are located opposite each other on opposed sides with respect to the vertical plane passing through the working axis indicated in A2. The two slides 35 and 36 slide vertically and at the same time in opposite directions under the action of the respective control levers 38 and 39 operating against the return springs 40 and 41. The slides 35 and 36 slide within seats machined on guideways 42 and 43 oscillating around the pin 44 under the action of a wedge 45 which, upon action of the lever 46, slides vertically, penetrating between the two guides and making the clamps 37 approach each other. The clamps define a cavity 47 within which the two already-coupled link members are placed, to form a link. The link forming group is assembled on a movable support 48 which slides vertically under the action of the two lift 49 and descent 50 levers (see FIGS. 3 and 6*a*) causing either the approach or the retreat of the clamps 37 from the working position A2.

The welding device 6, shown in detail in FIGS. 3, 5*a* and 7, comprises two vice arms 51 extending vertically above the clamps 37 in correspondence with the working position A2, hinged on pins 52 carried by a slide 53 vertically movable under the action of the lever 54 on a bracket 55 fastened to the structure 1 of the apparatus. At the ends of the arms 51 two electrodes 56 are placed in alignment, the opposite ends of which may be caused to approach one another by rotating the arms 51 around the pins 52 under the action of the wedge 57, slidable on a suitable guideway 58 machined on the slide 53, under the action of the lever 59 operating against the return spring 60.

The operation of the apparatus according to the present invention will now be disclosed with reference to FIGS. 8 to 16, which also show the various operation steps of the process according to the invention.

Figure 8:
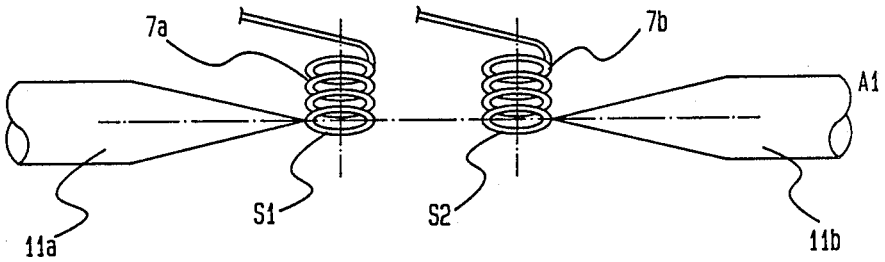
FIGS. 8 to 16 show schematically the various steps according to which the process of the invention develops.
Figure 9:
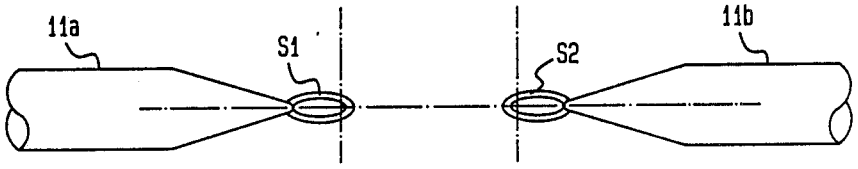
Figure 10:
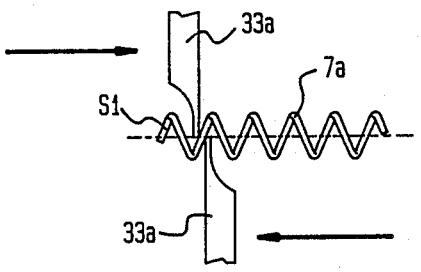
Figure 11:
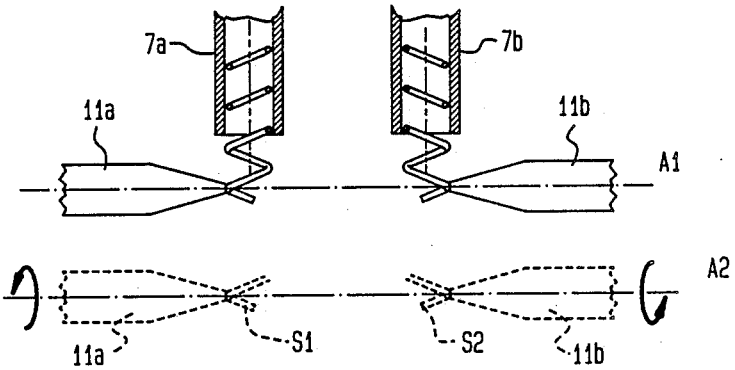
Figure 12:
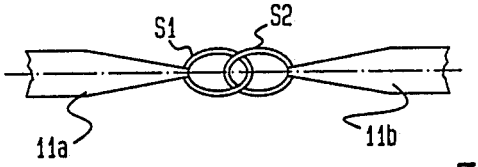

With reference to FIG. 8, two continuous spirals 7*a* and 7*b* are produced in the spiral production unit 2. The two spirals are placed side-by-side, with parallel axes, and develop in the same direction. The two spirals 7*a* and 7*b* are of the open type, i.e., with turns spread apart and the two free ends of the first turn, indicated in S1 and S2, symmetrically placed one against the other. The two spirals 7*a* and 7*b* advance simultaneously with an intermittent motion making a complete revolution each time so that the two first turns S1 and S2 carry their average planes into alignment with the working position A1, in correspondence with which the two vices 11*a* and 11*b* are already located, one of which has just engaged with last link (not shown) of the chain already formed with one of the two turns, either S1 or S2. The two vices 11*a* and 11*b* approach the turns S1 and S2 constituting the link member to be joined, in order to form the actual link of the chain, and grasp said turns in correspondence with the opposite side of their free ends, as shown in FIG. 9.

Once the grasping of the turns S1 and S2 by the vices 11*a* and 11*b* has been performed, the turns are separated from the respective spirals (see FIG. 10) by means of the pair of blades 33*a* (or 33*b*) of the group of knives 4*a* (4*b*). The cut is performed in correspondence with the side opposite to the one held by the respective vices and in correspondence with the free end of the turn, so as to detach a turn developing for about 360°, but with the ends spread apart in opposed directions with respect to the average lying plane.

At this moment (see FIG. 11) the vices translate parallel to each other from the working position A1 to the working position A2. In this position, one or both the vices rotate through a given angle to compensate for the pitch of the turn, placing the two turns on lying planes offset from each other by about 90°. Then the two turns or link elements are brought towards each other along their alignment axis (see FIG. 12), so that the free ends of one are about halfway along the other. Then either one or both the vices rotate again in a direction opposed to the former until contacting the sides of the two link elements. After this the two link elements so coupled are placed in the cavity 47 of the two clamps 37, which in the meanwhile have lifted from their rest position up to the operating position located on the axis A2. Under the effect of the motion of the clamps 37 themselves, the two link elements S1 and S2 are subjected to compression (see FIG. 13), both in a direction normal to their average lying plane (arrows f1), and in a diametral direction on the same plane of said plane (arrows f2) causing the deformation shown in FIG. 14, so that the extreme ends of each of the two link elements S1 and S2 are crossed over each other and the two free ends of said terminal portions of a link element contact the internal contour of the other about half-way along it. While the links so defined are still firmly blocked in the two clamps 37, these are further deformed (see FIG. 15) through an axial twisting action by the rotation in opposite directions of the vices 11*a* and 11*b*, in particular through an angle of 45°.

Figure 15:
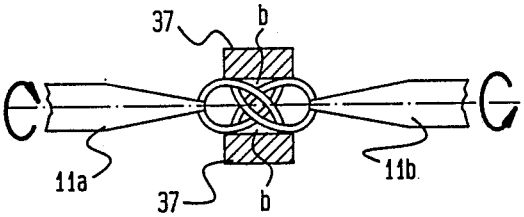
Figure 16:
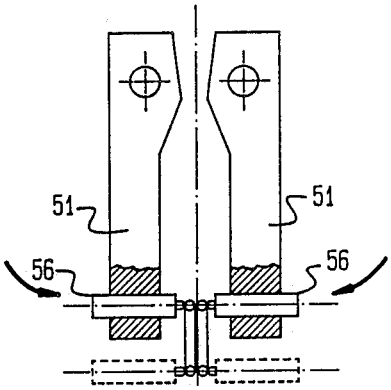

Once the twisting of the links has been performed, the clamps 37 are lowered into their rest position, giving place to the welding vices 51 (see FIG. 16), which descend in correspondence with the working position A2 from their rest position and with their electrodes 56 clamp onto opposite edges of the link formed, welding it in correspondence by the overlap points, shown with b in FIG. 15, of the two coupled link elements S1 and S2. When the welding has been carried out, the arms 51 lift from the working position A2, one of the two vices 11*a* and 11*b* is opened leaving the respective link element now firmly coupled to the other, and positioning itself close to the respective spiral which in the meantime has made a revolution through 360° thus carrying its first turn into correspondence with the working position A1. The other vice, carrying the formed link, in the meantime, is positioned near the respective sprial, the free end of which is inserted into the free link element of the link which has just been formed, opposite to the one clamped by the vice. In this way the linking of the new turn with the last link formed is obtained, said link being definitely coupled to the portion of chain already formed. At this moment the vices 11*a* and 11*b* grasp the next two turns S1 and S2 of the spirals 7*a* and 7*b*, repeating the production cycle.

According to a second embodiment of the present invention, a process is provided that may be of use particularly when a continuous link-by-link welding operation has to be avoided, and a conventional welding over the entire chain is preferred. This entails that, on forming each link from the two relevant link elements, the connection to between the two link elements has to be made as close as possible to prevent the raw chain from coming apart during subsequent handling before the welding.

To the extent that the method described above for forming the chain according to the first embodiment is the same as for the second embodiment, a full description will not be provided. Only those steps and materials that are different will be discussed.

Figure 17:
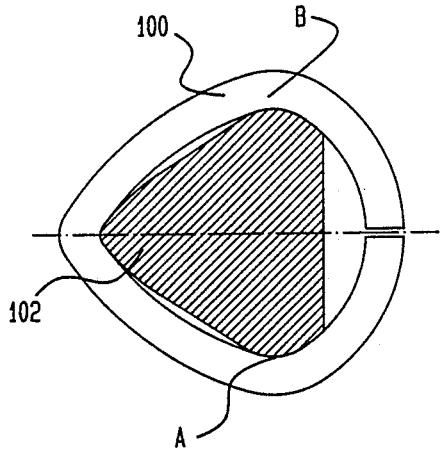
FIG. 17 shows a front view of a spiral according to a second embodiment of the present invention.
Figure 18:
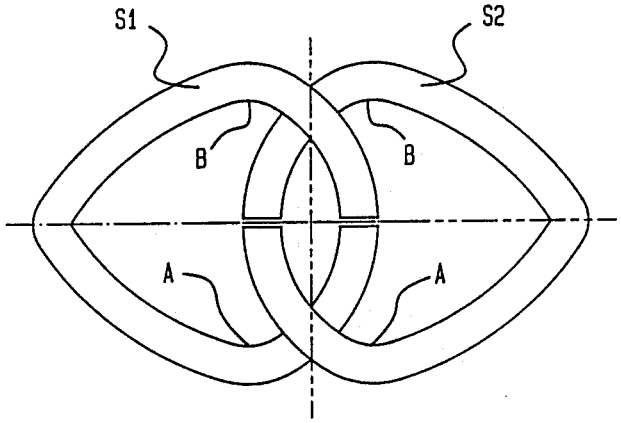
FIG. 18 shows two link members formed of the spiral shown in FIG. 17 after they have been connected together.

According to the second embodiment, the link elements are formed from a specially shaped spiral (and not ellyptical or circular spiral). A front view of such a spiral is shown in FIG. 17, where 100 denotes a spiral turn already cut and 102 the shaping pin of substantially triangular cross-section. The resulting link element has a generally ovoidal shape with two profile discontinuities A and B in the inner side. FIG. 18 shows two link members after they have been connected by means of vices 11*a* and 11*b* (this step corresponds to that shown in FIG. 12).

Figure 13:
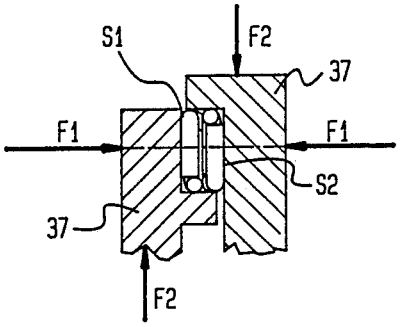
Figure 13A:
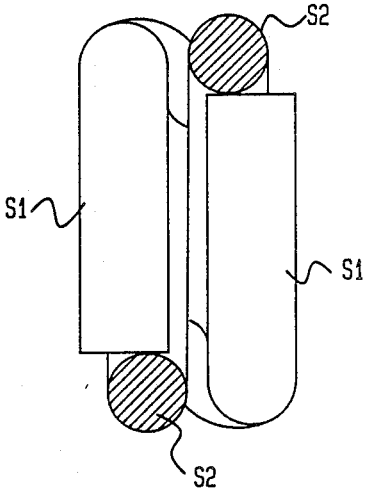
Figure 14:
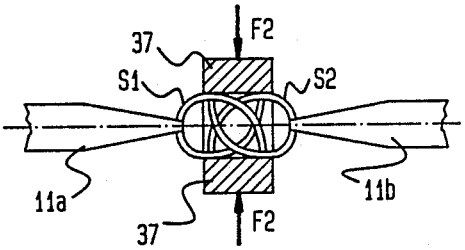
Figure 19:
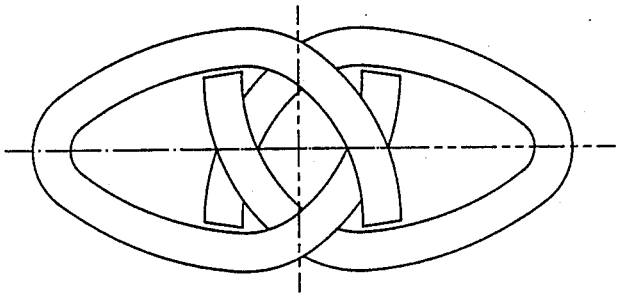
FIG. 19 shows the two link members after they have been compressed according to the second embodiment of the present invention.

The link compression performed by clamps 37 in the direction of arrows F (see FIG. 13) occurs in two subsequent steps. With the first compression step the free ends of one link member approach, but do not come into complete alignment with, the internal profile of the other link member (see FIG. 13*a*). While the link members are still firmly blocked between clamps 37, vices 11*a* and 11*b* are first rotated in opposite directions (see FIG. 15) through an angle greater than 45°, whereby the link members are twisted in opposite directions, and second, the direction of rotation of each vice is inverted and a new rotation of an angle equal to an angle exceeding 45° is performed. At the same time, the second compression step is performed by means of which the free ends of one link member is brought into alignment with the internal profile of the other link member. The configuration of the resulting link is shown in FIG. 19 and, as can be seen, is substantially equal to that of a link obtained with the method disclosed in the first embodiment, with the difference of a more tight and stable connection between the link members. This is due to the fact that the two profile discontinuities A and B formed on the link members act as abutments for the free ends of the link members during the subsequent compression and twisting steps, thereby any axial sliding of the link members forming the chain is avoided. This result is also due to the fact that any spring-back effect is eliminated with the two-step compression and twisting thus avoiding the loosening of the links in the transverse direction.

The above described variation of the method according to the invention has been proven particularly useful when the chain is formed by very small links or the diameter of the wire is very small.

The previously described welding device 6 operates according to the working principle of the conventional spot welders. As is known, the electric discharge produced by the electrodes of these welding machines, when the two pieces to be welded are interposed between them, causes local melting of the two pieces and consequently their welding. The current pulse which causes the welding in conventional spot welding machines is adjusted only with respect to the current intensity, i.e., it is brought to its maximum value, remaining there for predetermined time and then returning to zero. The welding device adopted in the apparatus according to the present invention has been suitably adapted to the specific needs with respect to the convention spot welding machines.

As a matter of fact, to avoid the sparking which would damage the external surface of the piece, a sparking caused, as is known, by an imperfect surface contact between electrodes and workpiece, the electrodes 56 are first brought against the link under moderate pressure in order to obtain an adequate contact, and then the current pulse for the welding is activated. Moreover, while in the conventional spot welding machines the current pulse rises immediately to the maximum value, in the case of the welding device applied in the apparatus according to the present invention, the current pulse is gradually brought to the maximum value. In this way the heating of the workpiece in correspondence with the melting area occurs equally, thus generally allowing the material to settle and avoiding thermal shocks. It should also be remembered that while the conventional spot welding machines the current pulses are provided for times of a few seconds, in the present case said pulses have a duration in the order of some tens of milliseconds, adjusted by means of a timer.

Insofar as the forming of the link elements S1 and S2, it is clear that they may be produced separately, in this case the related apparatus, in place of the unit 3 for producing the spirals, will comprise distributing devices, of a known kind, for the link elements and means for their linking with the last link of the chain portion already formed.

It is clear moreover, even if it is not disclosed in detail, that the apparatus according to the invention is provided with motor means for its activation, which rotate one or several cam shafts which, suitably timed, activate the control levers mentioned in the present disclosure and shown in the drawings. In the same way, means for the adjustment of all the moving elements and for their timing are provided in the apparatus according to the present invention. The specific description and illustration has been omitted because these components are commonly employed in this field and consequently they are well known to a person expert in the art.

Further changes and/or modifications may be introduced in the process and apparatus for the production of ornamental chains according to the present invention without departing from the scope of protection of the invention itself.

We claim:

1. A process for the automatic production of ornamental link chains, in particular of the kind known as "partridge's eye" in the field of precious and non-precious jewelry, comprising the steps of:

mutually engaging two link elements which are each shaped as a turn of a spiral, one of which is engaged with a last link of an already formed chain, by a pair of vices until free ends of one link element are substantially at the center of the other link element to form a link, said Link having a lying plane;

compressing the link resulting from the combination of said link elements by shaping means positioned around the link along two directions at right angles to each other, respectively on the same plane as and at right angles to the lying plane of the link, to deform the two link elements so that end portions of each one cross each other until bringing their ends into contact with an internal contour of the other;

axially twisting the link thus formed while being held in said shaping means; and engaging a free link element of the link so formed with a subsequent link element for the repetition of the cycle.

2. A process according to claim 1, further comprising, before the step of mutually engaging, the steps of:

forming two open spirals of precious or non-precious wire-like material; and cutting said link elements from said two open spirals two-by-two in an intermittent fashion.

3. A process according to claim 2, wherein said spirals are produced side-by-side with parallel axes and said link elements are separated therefrom after each rotation of the same through 360°.

4. A process according to claim 1, further comprising, before the step of engaging the free link element, the step of welding the points in contact between the intersecting edges of the two link elements.

5. A process according to claim 4, wherein the step of welding the contact points comprises the step of clamping the link with welding electrodes and then applying a current pulse which is gradually brought to its maximum value.

6. A process according to claim 1, wherein the spirals forming the link elements have a generally ovoidal shape with two profile discontinuities formed on an internal surface thereof.

7. A process according to claim 6, wherein the shaping means comprises two vices adapted to hold respective ones of the link elements being joined and the step of compressing the link comprises the steps of:

compressing free ends of one of said link elements such that the free ends approach, but do not come into complete alignment with an internal profile of the other link of said elements;

firstly rotating the vices in opposite directions with respect to one another through an angle greater than 45°, so that the link elements are twisted in opposite directions;

secondly rotating the vices in rotation directions opposite to the rotation directions, through an angle substantially equal to the angle greater than 45°;

substantially simultaneously with the second step of rotation, compressing the link elements such that free ends of one of said link elements are brought into alignment with the internal profile of the other of said link elements.

* * * * *